US011666191B2

(12) United States Patent
Koura et al.

(10) Patent No.: US 11,666,191 B2
(45) Date of Patent: Jun. 6, 2023

(54) ROTARY BRUSH AND ROBOTIC DUST COLLECTOR

(71) Applicant: MAKITA CORPORATION, Anjo (JP)

(72) Inventors: Kentaro Koura, Anjo (JP); Hirotaka Sumiyoshi, Anjo (JP)

(73) Assignee: MAKITA CORPORATION, Anjo (JP)

( * ) Notice: Subject to any disclaimer, the term of this patent is extended or adjusted under 35 U.S.C. 154(b) by 357 days.

(21) Appl. No.: 16/998,549

(22) Filed: Aug. 20, 2020

(65) Prior Publication Data

US 2021/0093136 A1 Apr. 1, 2021

(30) Foreign Application Priority Data

Sep. 30, 2019 (JP) ..... JP2019-179445

(51) Int. Cl.
*A47L 9/04* (2006.01)
*A47L 9/28* (2006.01)

(52) U.S. Cl.
CPC ..... *A47L 9/0466* (2013.01); *A47L 9/0411* (2013.01); *A47L 9/0427* (2013.01); *A47L 9/2884* (2013.01)

(58) Field of Classification Search
CPC .... A47L 9/0466; A47L 9/0411; A47L 9/0427; A47L 9/2884; A47L 11/164
See application file for complete search history.

(56) References Cited

U.S. PATENT DOCUMENTS

2017/0007085 A1 1/2017 Tahara
2019/0101129 A1* 4/2019 Teramoto ..... F04D 29/056

FOREIGN PATENT DOCUMENTS

CN 106333628 A 1/2017
JP S47-014937 U 10/1972
JP 2002065538 A * 3/2002 ..... A47L 11/164
JP 2002-065538 A 5/2002
JP 3182828 U 4/2013
JP 2014-221149 A 11/2014

OTHER PUBLICATIONS

JP2002065538A (machine translation) (Year: 2002).*
Feb. 8, 2022 Office Action issued in Chinese Patent Application No. 202010020315.8.
Feb. 28, 2023 Office Action issued in Japanese Patent Application No. 2019-179445.
Jan. 19, 2023 Office Action issued in Chinese Patent Application No. 202010824100.1.

* cited by examiner

*Primary Examiner* — Andrew A Horton
(74) *Attorney, Agent, or Firm* — Oliff PLC

(57) ABSTRACT

A rotary brush is easily attachable to and detachable from a body with less separation from the body during cleaning. A rotary brush attachable to a driving shaft rotatable about a rotation axis and including a protrusion includes a brush, a base to which the brush is attached, and a locking member that comes in contact with the base and the driving shaft to lock the base to the driving shaft.

20 Claims, 13 Drawing Sheets

ROTARY BRUSH AND ROBOTIC DUST COLLECTOR

CROSS-REFERENCE TO RELATED APPLICATIONS

This application claims the benefit of priority to Japanese Patent Application No. 2019-179445, filed on Sep. 30, 2019, the entire contents of which are hereby incorporated by reference.

BACKGROUND

1. Technical Field

The present disclosure relates to a rotary brush and a robotic dust collector.

2. Description of the Background

A robotic dust collector is used for cleaning. A robotic dust collector autonomously travels to clean a cleaning target surface. The robotic dust collector includes rotary brushes, called side brushes. Japanese Registered Utility Model No. 3182828 describes an example of a side brush.

BRIEF SUMMARY

Rotary brushes may be attachable to and detachable from the robotic dust collector body for easy maintenance by a user. During cleaning, however, the rotary brushes are to remain attached without separating from the body.

One or more aspects of the present disclosure are directed to a rotary brush that is easily attachable to and detachable from a body with less separation from the body during cleaning.

A first aspect of the present disclosure provides a rotary brush attachable to a driving shaft, the driving shaft being rotatable about a rotation axis and including a protrusion, the rotary brush including:

a brush;

a base to which the brush is attached; and a locking member configured to come in contact with the base and the driving shaft to lock the base to the driving shaft.

A second aspect of the present disclosure provides a robotic dust collector, including:

a housing including a bottom surface having a suction port;

a brush motor accommodated in the housing;

a driving shaft driven by the brush motor to rotate about a rotation axis; and a rotary brush attached to the driving shaft.

The rotary brush and the robotic dust collector according to the above aspects of the present disclosure allow easy attachment and detachment of the rotary brush to and from the body with less separation from the body during cleaning.

DETAILED DESCRIPTION

Although one or more embodiments will now be described with reference to the drawings, the present disclosure is not limited to the embodiments. The components in the embodiments described below may be combined as appropriate. One or more components may be eliminated.

In the embodiments, the positional relationships between the components will be described using the directional terms such as right, left, front, rear, up, and down. The terms indicate relative positions or directions with respect to the center of a robotic dust collector.

Robotic Dust Collector

Figure 1:
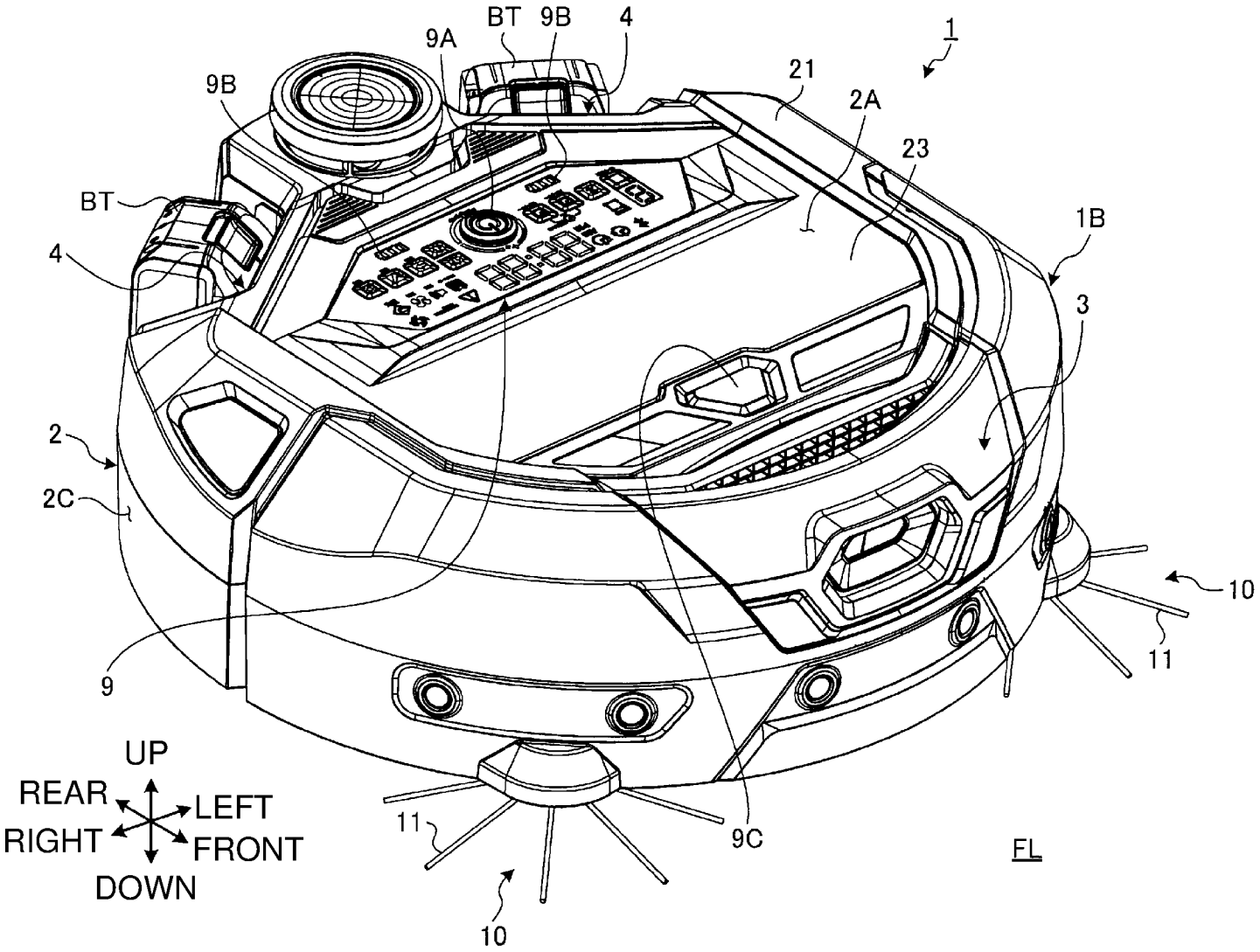
FIG. 1 is a perspective view of a robotic dust collector according to an embodiment.
Figure 2:
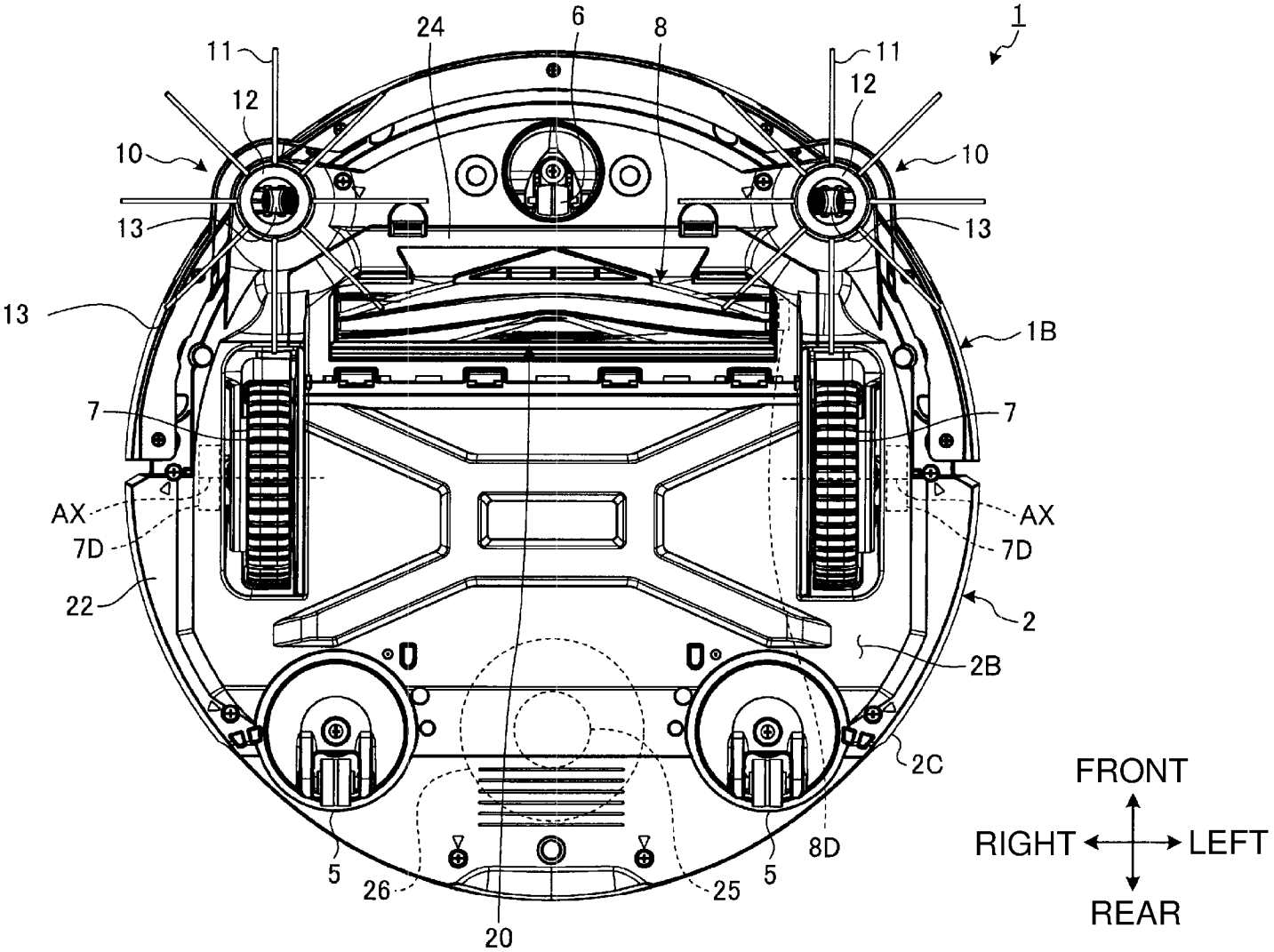
FIG. 2 is a bottom view of the robotic dust collector according to the embodiment.

FIG. 1 is a perspective view of a robotic dust collector 1 according to an embodiment. FIG. 2 is a bottom view of the robotic dust collector 1 according to the embodiment.

The robotic dust collector 1 autonomously travels over a cleaning target surface FL to collect foreign objects on the cleaning target surface FL. Examples of foreign objects on the cleaning target surface FL include dust, dirt, or hairy foreign objects such as hairs or threads.

As shown in FIGS. 1 and 2, the robotic dust collector 1 includes a body 1B, a bumper 3, battery mounts 4, casters 5, a roller 6, wheels 7, a main brush 8, an interface 9, and side brushes 10. The body 1B includes a housing 2.

The housing 2 has an internal space. The housing 2 forms at least a part of the body 1B. The housing 2 has an upper surface 2A, a bottom surface 2B, and a side surface 2C. The bottom surface 2B faces the cleaning target surface FL. The side surface 2C connects the peripheries of the upper surface 2A and the bottom surface 2B. In a plane parallel to the upper surface 2A, the housing 2 has a substantially circular shape.

The housing 2 includes an upper housing 21, a lower housing 22, a cover plate 23, and a bottom plate 24. The lower housing 22 is located below the upper housing 21. The cover plate 23 is attached to the upper housing 21 and can be open and closed. The bottom plate 24 is attached to the lower housing 22. The lower housing 22 is connected to the upper housing 21. The upper surface 2A serves as the upper housing 21 and the cover plate 23. The bottom surface 2B serves as the lower housing 22 and the bottom plate 24.

The bumper 3 is movable while facing at least a part of the side surface 2C. The bumper 3 is movably supported by the housing 2. The bumper 3 faces a front portion of the side surface 2C. When colliding against an object around the robotic dust collector 1, the bumper 3 moves toward the housing 2 to reduce shock to the housing 2.

The battery mounts 4 support batteries BT. The batteries BT are mounted on the battery mounts 4. Each battery mount 4 is at least partially located on the outer surface of the housing 2. The upper housing 21 has recesses on rear portions. The battery mounts 4 are received in the recesses on the upper housing 21. In the present embodiment, the housing 2 includes two battery mounts 4.

When mounted on the battery mounts 4, the batteries BT power an electrical or electronic device installed on the robotic dust collector 1. The batteries BT are general-purpose batteries usable as a power supply for various electrical devices. The batteries BT are usable as a power supply for a power tool, an electrical device other than a power tool, or a dust collector other than the robotic dust collector according to the present embodiment. The batteries BT include a lithium ion battery. The batteries BT are rechargeable. The battery mounts 4 have the same structure as a battery mount included in a power tool.

A user of the robotic dust collector 1 attaches the batteries BT to the battery mounts 4, and detaches the batteries BT from the battery mounts 4. Each of the battery mounts 4 includes a guide and a body terminal. The guide guides the corresponding battery BT. The body terminal is connected to a battery terminal on the corresponding battery BT. The user places each battery BT onto the battery mount 4 from above to attach the battery BT to the battery mount 4. The battery BT is placed onto the battery mount 4 while being guided by the guide. Thus, the battery terminal on the battery BT and the body terminal on the battery mount 4 are electrically connected. The user moves the battery BT upward to detach the battery BT from the battery mount 4.

The casters 5 and the roller 6 movably support the housing 2. The casters 5 and the roller 6 are rotatably supported by the housing 2. The casters 5 are two casters located in rear portions of the bottom surface 2B. One caster 5 is located in a left portion of the housing 2, and the other caster 5 in a right portion of the housing 2. The single roller 6 is located in a front portion of the bottom surface 2B.

The wheels 7 movably support the housing 2. The wheels 7 each rotate about a wheel rotation axis AX. The wheel rotation axis AX extends in the lateral direction. The robotic dust collector 1 includes two wheels 7. One wheel 7 is located in a left portion of the housing 2, and the other wheel 7 in a right portion of the housing 2.

The wheels 7 are connected to wheel motors 7D, which generate power to rotate the wheels 7. The wheel motors 7D are driven by power from the batteries BT. The wheel motors 7D are located in the internal space of the housing 2. The wheels 7 are driven by the wheel motors 7D to rotate. The robotic dust collector 1 thus travels autonomously.

The wheels 7 at least partially protrude downward from the bottom surface 2B. The wheels 7 support the housing 2 to leave a gap between the bottom surface 2B and the cleaning target surface FL facing each other.

The housing 2 has a suction port 20 in the bottom surface 2B. The suction port 20 is formed in the bottom plate 24. Foreign objects on the cleaning target surface FL are sucked through the suction port 20. The suction port 20 faces the cleaning target surface FL. The suction port 20 is located in a front portion of the bottom surface 2B. The suction port 20 is rectangular and elongated in the lateral direction.

A suction motor 25 and a suction fan 26 are located in the internal space of the housing 2. The suction motor 25 generates power to rotate the suction fan 26. The suction motor 25 is driven by power from the batteries BT. As the suction motor 25 is driven to rotate the suction fan 26, a suction force occurs at the suction port 20, which thus sucks foreign objects on the cleaning target surface FL.

The main brush 8 is received in the suction port 20. The main brush 8 faces the cleaning target surface FL. The main brush 8 is elongated in the lateral direction. The main brush 8 rotates about a brush rotation axis, which extends laterally. The main brush 8 is rotatably supported by at least a part of the housing 2. The main brush 8 is supported by the housing 2 while at least partially protruding downward from the bottom surface 2B. With the wheels 7 in contact with the cleaning target surface FL, the main brush 8 at least partially comes in contact with the cleaning target surface FL. Dust on the cleaning target surface FL is stirred up as the main brush 8 rotates. The dust is then sucked through the suction port 20.

The main brush 8 is connected to a main brush motor 8D. The main brush motor 8D generates power to rotate the main brush 8. The main brush motor 8D is driven by power from the batteries BT. The main brush motor 8D is located in the internal space of the housing 2. The main brush motor 8D is driven to rotate the main brush 8.

The interface 9 is located at the rear of the cover plate 23. The interface 9 includes multiple operation units 9A and multiple displays 9B. The multiple operation units 9A are operable by a user. Examples of the operation units 9A include power buttons. Examples of the displays 9B include battery indicators for the batteries BT. For example, a light emitter 9C including a light-emitting diode is located in a front portion of the upper housing 21.

Side Brush

Figure 3:
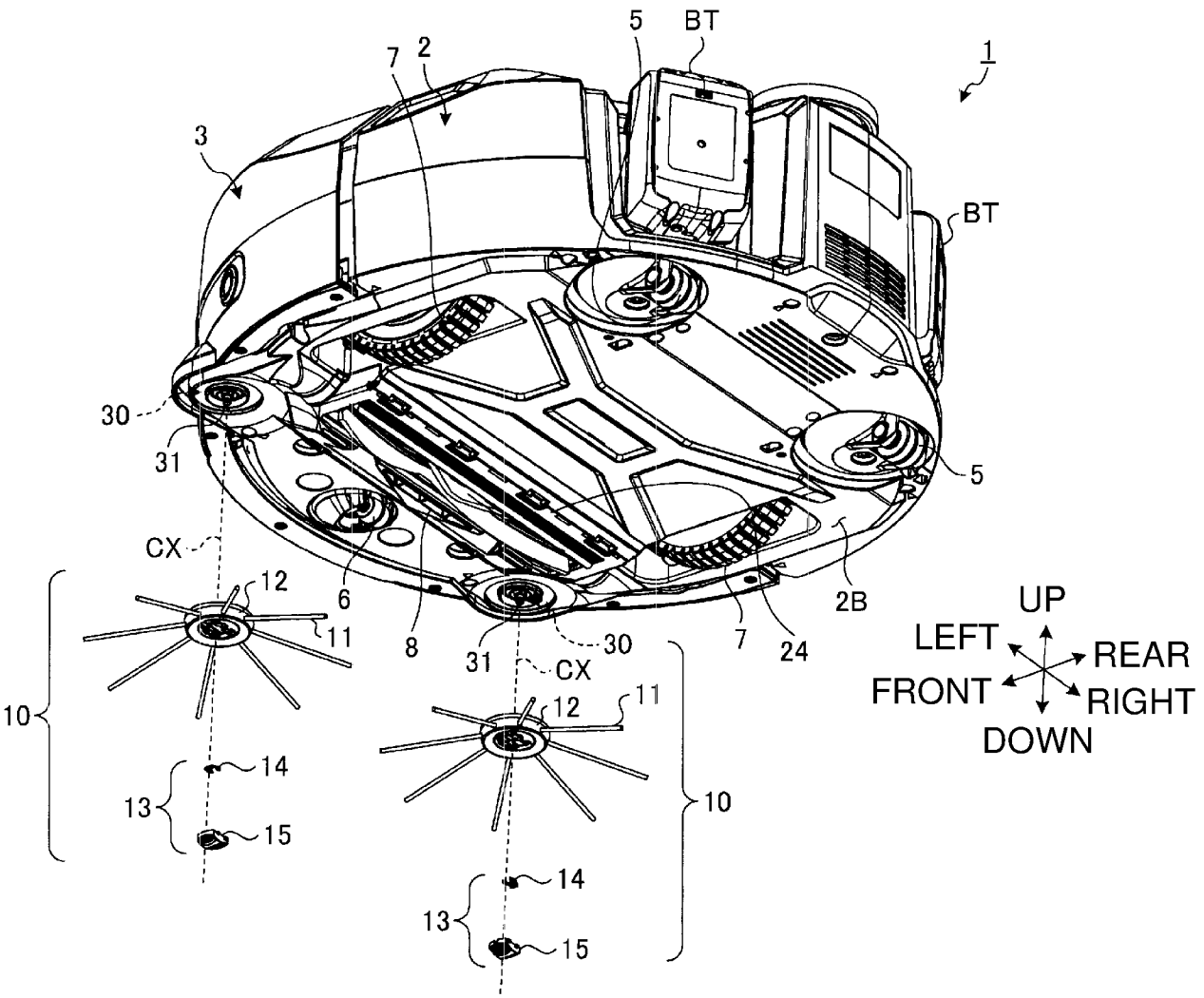
FIG. 3 is an exploded perspective view of the robotic dust collector according to the embodiment.

FIG. 3 is an exploded perspective view of the robotic dust collector 1 according to the embodiment. As shown in FIGS. 1 to 3, the side brushes 10 are located in front portions of the bottom surface 2B. The side brushes 10 face the cleaning target surface FL. The side brushes 10 are at least partially located frontward from the housing 2. The side brushes 10 are two side brushes located on the bottom surface 2B. One side brush 10 is located on the left of the suction port 20, and the other side brush 10 on the right of the suction port 20.

The side brushes 10 each rotate about a rotation axis CX. The rotation axis CX extends vertically. Hereafter, a direction parallel to each rotation axis CX is referred to as an axial direction (or axially) for convenience. A direction radial from the rotation axis CX is referred to as a radial direction (or radially) for convenience. A direction about the rotation axis CX is referred to as a circumferential direction (or circumferentially) or a rotation direction for convenience. A position nearer the rotation axis CX in the radial direction, or a radial direction toward the rotation axis CX, is referred to as radially inward for convenience. A position farther from the rotation axis CX in the radial direction, or a radial direction away from the rotation axis CX, is referred to as radially outward for convenience.

The robotic dust collector 1 includes side brush motors 30 and driving shafts 31. The side brush motors 30 are accommodated in the housing 2. The driving shafts 31 are driven by the side brush motors 30 to rotate about the rotation axes CX. The side brushes 10 are attached to the driving shafts 31.

The side brush motors 30 each include a motor unit (not shown) and a gear unit 30G. The motor unit generates power to rotate the side brush 10. The gear unit 30G transmits power generated by the motor unit to the side brush 10. The motor unit is driven by power from the batteries BT. The side brush motors 30 are located in the internal space of the housing 2. The side brushes 10 are driven by the side brush motors 30 to rotate. Foreign objects on the cleaning target surface FL around the housing 2 thus move into the suction port 20.

The side brushes 10 each include a base 12 and a locking member 13. Brushes 11 are attached to the bases 12. The locking member 13 locks the base 12 to the driving shaft 31. The locking member 13 includes a fastener 14 and a cap 15. The cap 15 supports the fastener 14.

The base 12 is attached to the driving shaft 31 with the brushes 11 at least partially protruding outward from the side surface 2C and at least partially overlapping the suction port 20. With the wheels 7 being placed on the cleaning target surface FL, the brushes 11 at least partially come in contact with the cleaning target surface FL.

Figure 4:
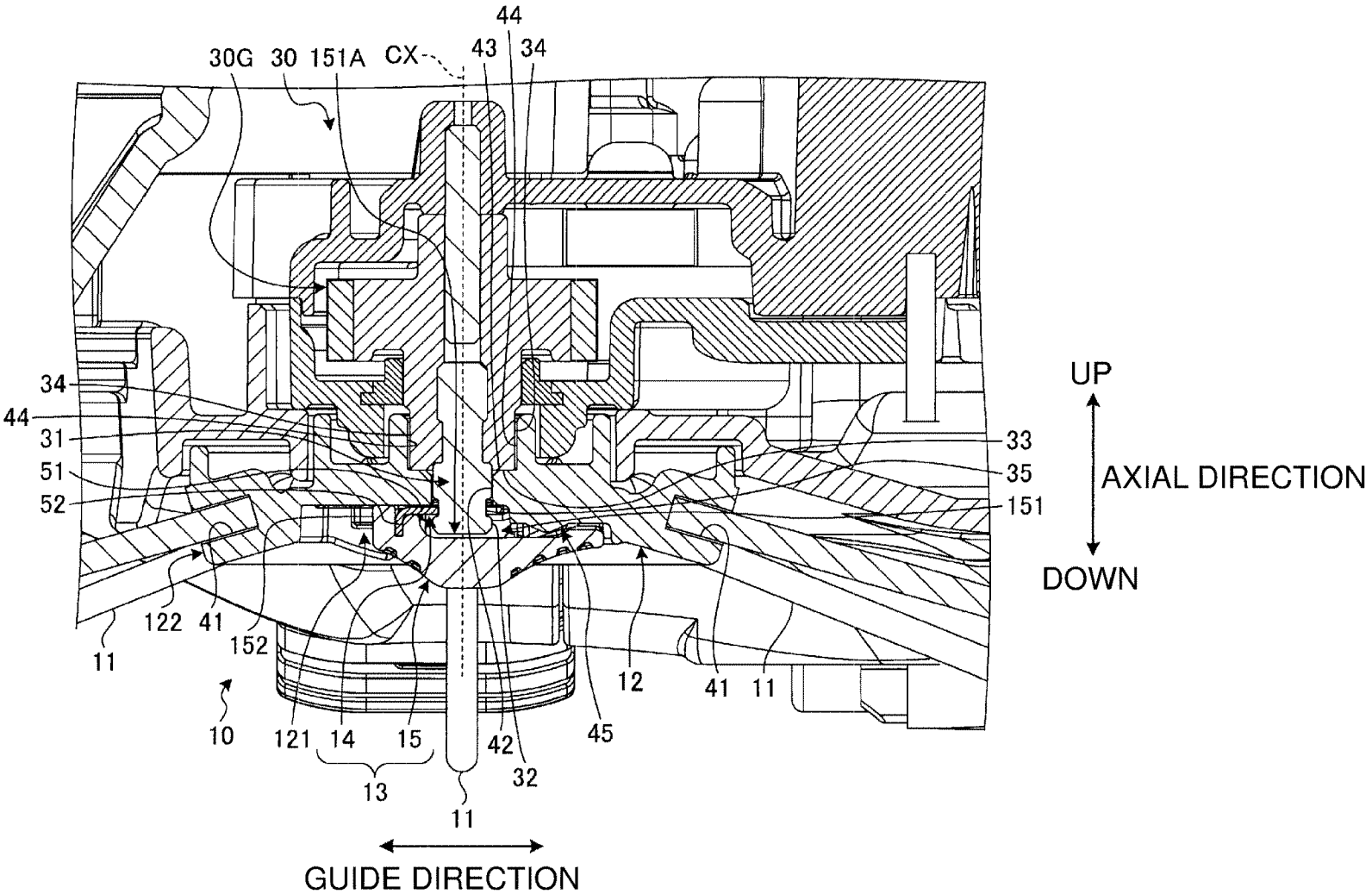
FIG. 4 is a cross-sectional view of a side brush according to the embodiment.
Figure 5:
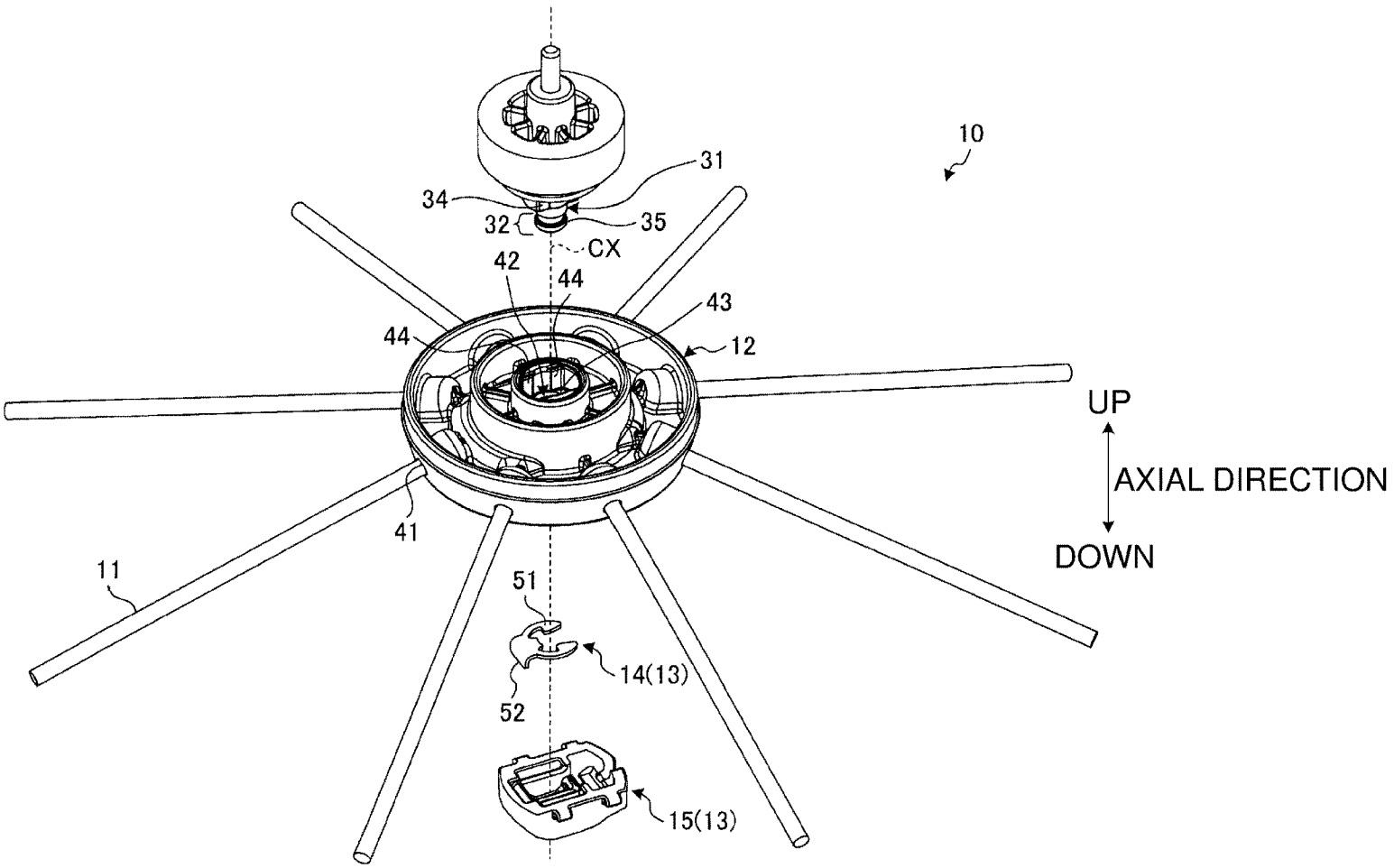
FIG. 5 is an exploded perspective view of the side brush according to the embodiment.
Figure 6:
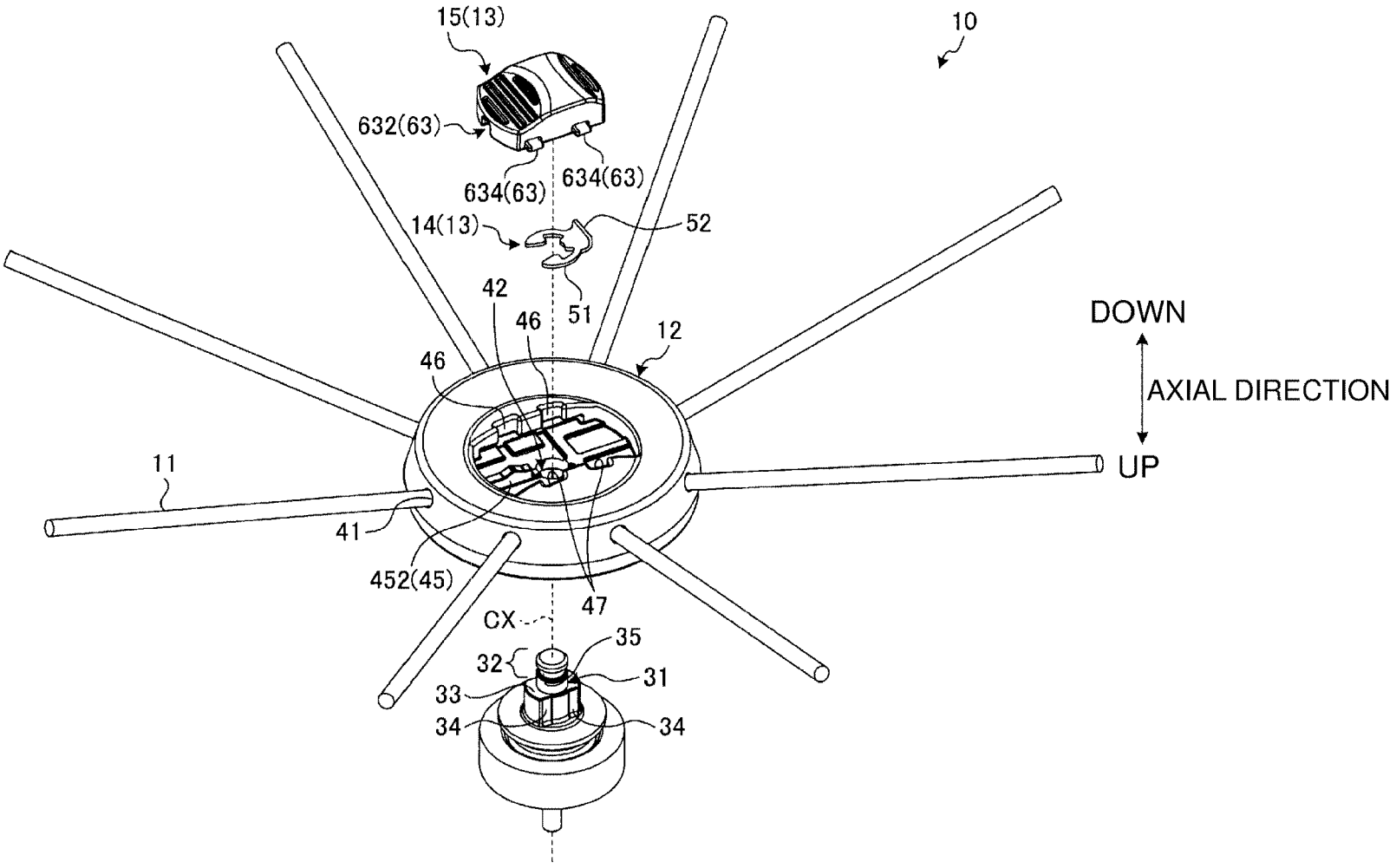
FIG. 6 is an exploded perspective view of the side brush according to the embodiment.
Figure 7:
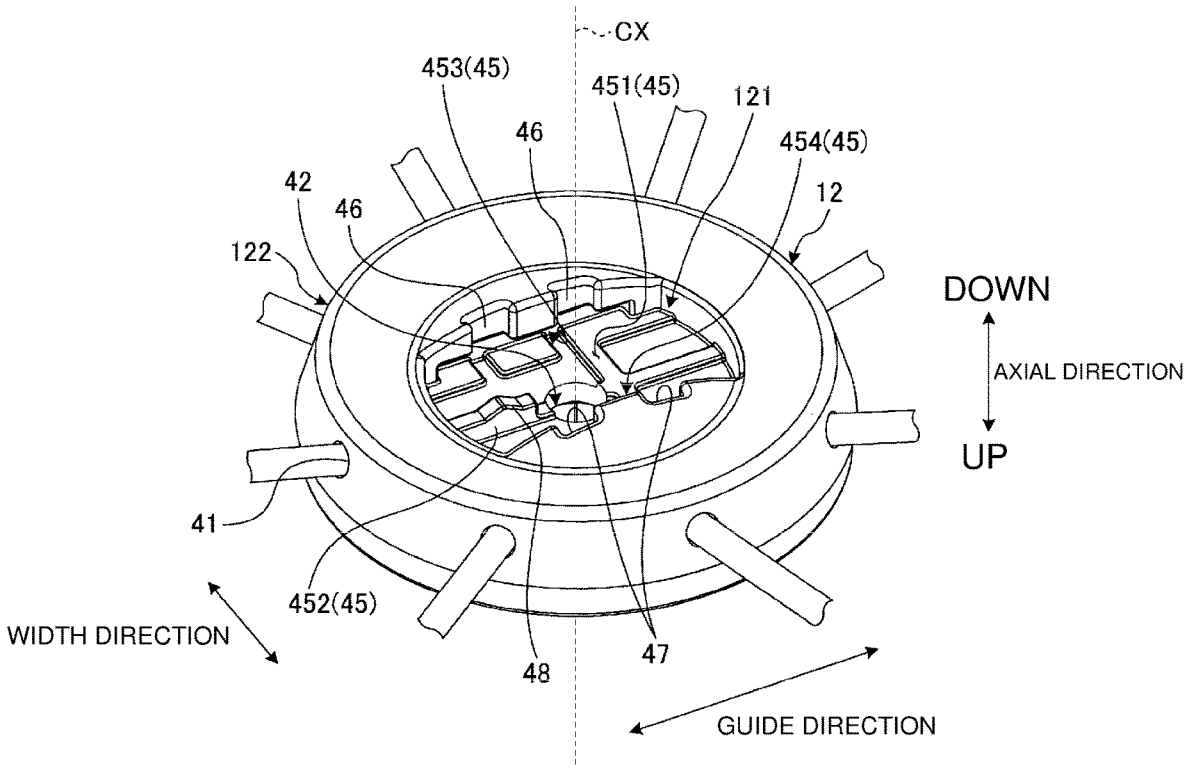
FIG. 7 is a perspective view of a base according to the embodiment as viewed from below.

FIG. 4 is a cross-sectional view of the side brush 10 according to the embodiment. FIG. 5 is an exploded perspective view of the side brush 10 as viewed from above. FIG. 6 is an exploded perspective view of the side brush 10 as viewed from below. FIG. 7 is a perspective view of the base 12 according to the embodiment as viewed from below.

As shown in FIGS. 4 to 7, the base 12 is a disk. The base 12 has a recess 121 and a peripheral wall 122. The peripheral wall 122 defines the recess 121 inside. The recess 121 extends upward on the lower surface of the base 12.

The base 12 has recesses 41, which receive the brushes 11. The recesses 41 are formed on the outer surface of the peripheral wall 122. The multiple recesses 41 are arranged circumferentially at intervals about the rotation axis CX. The multiple recesses 41 each receive the brush 11. The brushes 11 are radially connected to the base 12.

The base 12 has a hole 42 for receiving the driving shaft 31. The hole 42 is formed at the center of the base 12. The hole 42 extends through the base 12. The driving shaft 31 at least partially protrudes downward from a lower end of the hole 42, while being at least partially received in the hole 42.

A portion of the driving shaft 31 protruding from the lower end of the hole 42 is hereafter referred to as a protrusion 32 for convenience. The protrusion 32 includes a lower end of the driving shaft 31.

A first support surface 33 surrounds the driving shaft 31. The first support surface 33 is located above the protrusion 32. The first support surface 33 is located on at least a part of the side brush motor 30. The first support surface 33 is orthogonal to the rotation axis CX. The first support surface 33 includes a flat surface.

Second support surfaces 34 surround the driving shaft 31. The second support surfaces 34 are located above the first support surface 33. The second support surfaces 34 connect to at least a part of the periphery of the first support surface 33. The second support surfaces 34 are located on at least a part of the side brush motor 30. The second support surfaces 34 are parallel to the rotation axis CX. Each second support surface 34 includes a flat surface.

The base 12 includes a first facing surface 43 facing the first support surface 33. The first facing surface 43 at least partially defines the hole 42. The first facing surface 43 is orthogonal to the rotation axis CX. The first facing surface 43 includes a flat surface.

The base 12 includes second facing surfaces 44 facing the second support surfaces 34. The second facing surfaces 44 at least partially define the hole 42. The second facing surfaces 44 are parallel to the rotation axis CX. Each second facing surface 44 includes a flat surface.

With the driving shaft 31 received in the hole 42, the first support surface 33 and the first facing surface 43 are in contact with each other. The base 12 is thus positioned axially with respect to the driving shaft 31.

With the driving shaft 31 received in the hole 42, the second support surfaces 34 and the second facing surfaces 44 are in contact with each other. The base 12 is thus positioned radially and circumferentially with respect to the driving shaft 31.

The base 12 includes a guide 45 orthogonal to the rotation axis CX. The guide 45 guides the locking member 13. The guide 45 is located inside the peripheral wall 122.

The direction in which the guide 45 guides the locking member 13 is hereafter referred to as a guide direction for convenience. The guide direction is orthogonal to the rotation axis CX. More specifically, the axial direction and the guide direction are orthogonal to each other. The direction orthogonal to the axial direction and the guide direction is hereafter referred to as a width direction for convenience.

As shown in FIG. 7, the guide 45 extends in the guide direction. The guide 45 includes a guide surface 451 and a guide rib 452. The guide surface 451 surrounds the lower end of the hole 42. The guide rib 452 is located on the guide surface 451.

The guide surface 451 is located in the recess 121. The guide surface 451 includes a flat surface orthogonal to the rotation axis CX.

The guide rib 452 protrudes downward from the guide surface 451. The guide rib 452 extends in the guide direction. The single guide rib 452 is located adjacent to the lower end of the hole 42. The guide rib 452 extends radially outward from the lower end of the hole 42.

The guide 45 has a first guide groove 453 and a second guide groove 454. The first guide groove 453 extends in the guide direction. The second guide groove 454 extends facing the first guide groove 453.

The first and second guide grooves 453 and 454 are formed on at least parts of the inner surface of the peripheral wall 122. The first and second guide grooves 453 and 454 are arranged apart in the width direction. The hole 42 is formed between the first and second guide grooves 453 and 454 in the width direction. In other words, the first and second guide grooves 453 and 454 are located on the opposite sides of the hole 42 in the width direction.

The first guide groove 453 and the second guide groove 454, which each extend in the guide direction, are on opposite portions of the inner surface of the peripheral wall 122 in the width direction and are recessed opposite to each other in the width direction.

Figure 8:
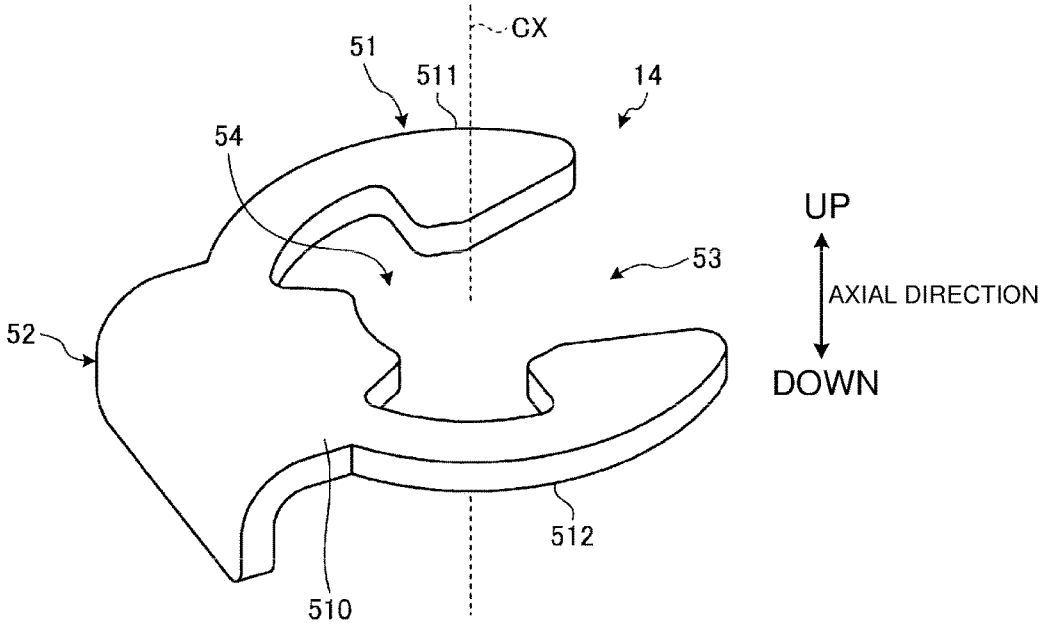
FIG. 8 is a perspective view of a fastener according to the embodiment as viewed from above.

FIG. 8 is a perspective view of the fastener 14 according to the embodiment as viewed from above. As shown in FIGS. 4 to 6 and 8, the fastener 14 includes a fastening portion 51 and a tab 52. The fastening portion 51 at least partially surrounds the driving shaft 31. The tab 52 protrudes from the fastening portion 51 in the axial direction.

The fastening portion 51 includes a base 510, a first arc 511, and a second arc 512. The basal ends of the first and second arcs 511 and 512 connect to the base 510. The distal ends of the first and second arcs 511 and 512 are apart from each other. The base 510, the first arc 511, and the second arc 512 surround the rotation axis CX.

The tab 52 protrudes downward from the base 510 in the axial direction.

The fastener 14 is processed from a single metal plate. The tab 52 is a bend of the metal plate. The fastener 14 is elastically deformable. The fastener 14 includes a circlip.

The fastener 14 has an opening 53 between the distal ends of the first and second arcs 511 and 512. The protrusion 32 of the driving shaft 31 can pass through the opening 53. The protrusion 32 has a diameter larger than the dimension of the opening 53. When the protrusion 32 passes through the opening 53, the fastener 14 deforms elastically. The opening 53 is thus enlarged to allow the protrusion 32 to pass through.

The fastener 14 also includes a space 54, which receives the protrusion 32. The protrusion 32 is placed into the space 54 of the fastener 14 through the opening 53. As described above, when the protrusion 32 passes through the opening 53, the fastener 14 deforms elastically. The protrusion 32 thus passes through the opening 53. After passing through the opening 53, the protrusion 32 is received in the space 54. With the protrusion 32 received in the space 54, the fastener 14 is elastically deformed back to restore the initial shape.

The fastener 14 at least partially surrounding the protrusion 32 comes in contact with the protrusion 32. The fastening portion 51 of the fastener 14 fastens the protrusion 32.

The protrusion 32 has a groove 35. The fastener 14 is at least partially received in the groove 35 with the protrusion 32 received in the space 54. In the present embodiment, the first and second arcs 511 and 512 are partially fitted in the groove 35.

Figure 9:
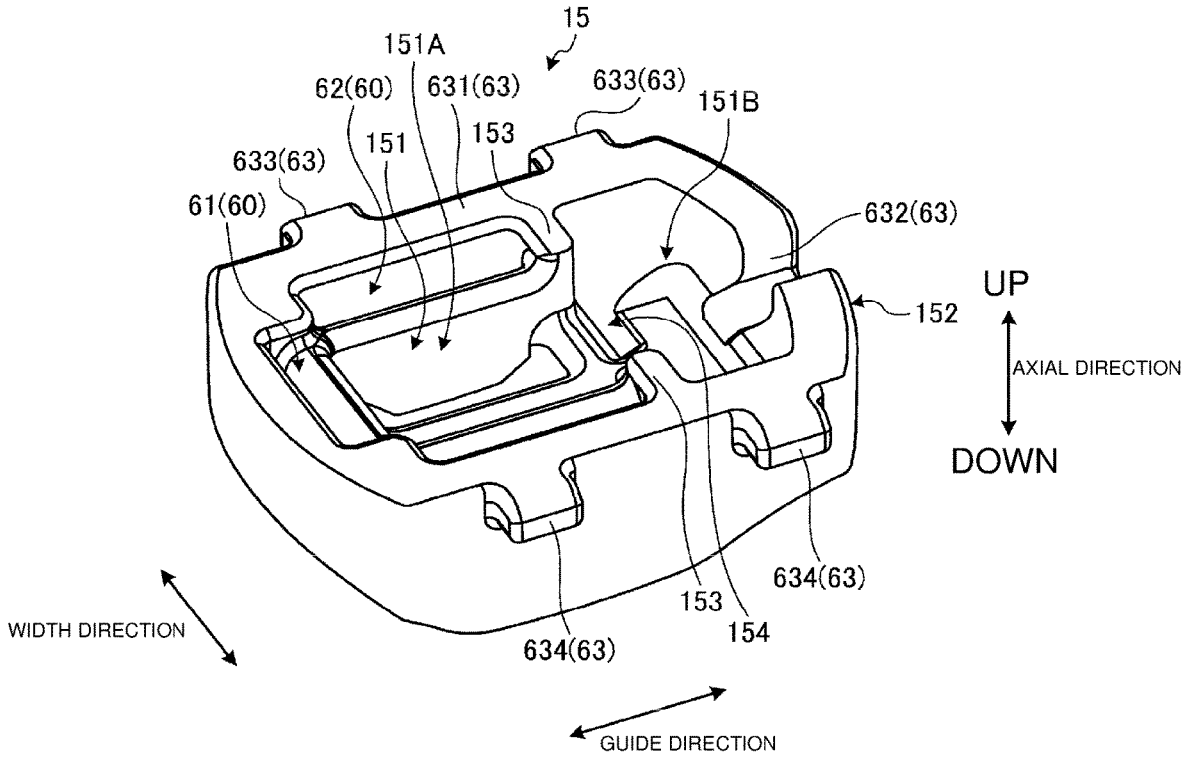
FIG. 9 is a perspective view of a cap according to the embodiment as viewed from above.
Figure 10:
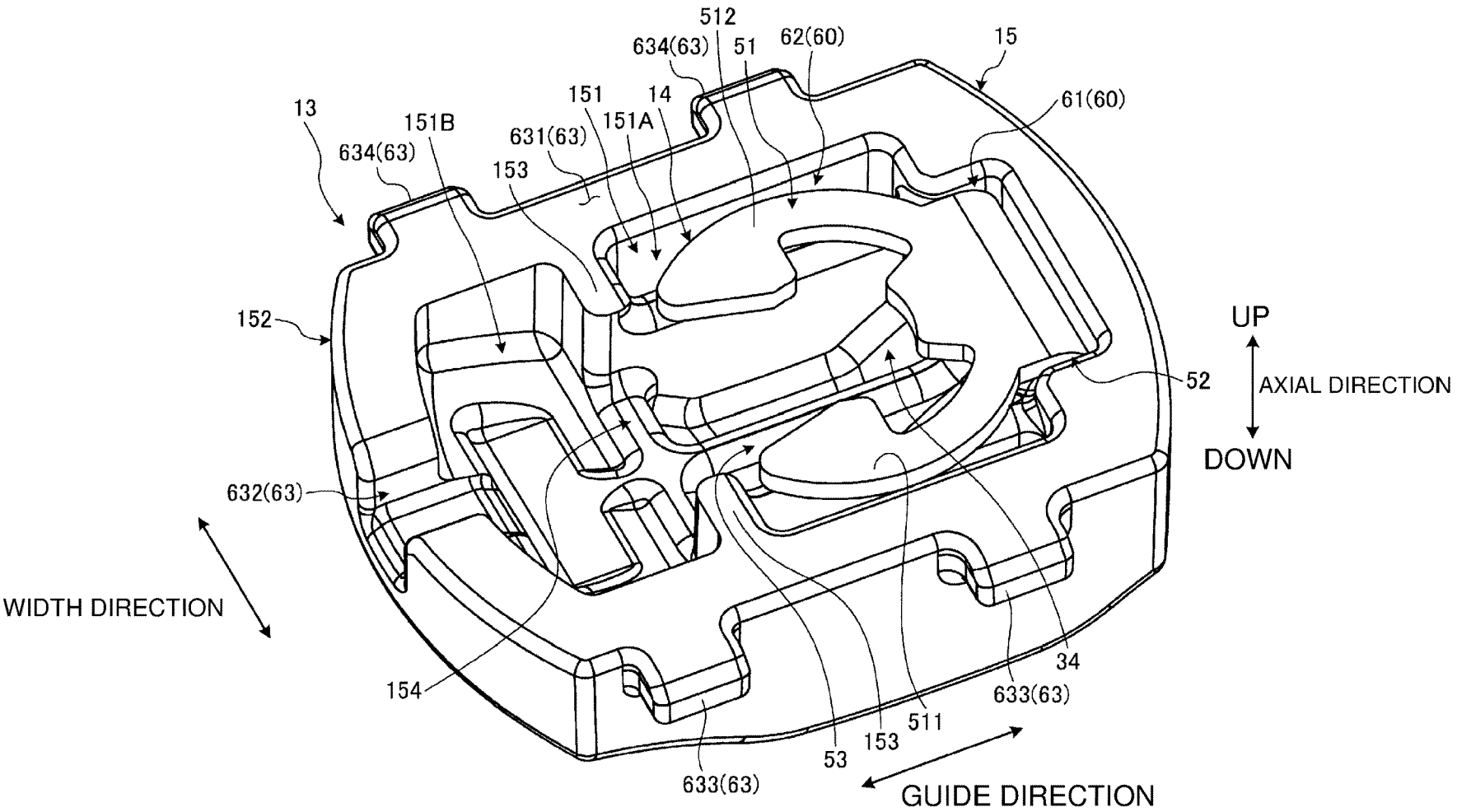
FIG. 10 is a perspective view of the fastener and the cap according to the embodiment as viewed from above.

FIG. 9 is a perspective view of the cap 15 according to the embodiment as viewed from above. FIG. 10 is a perspective view of the fastener 14 and the cap 15 according to the embodiment as viewed from above. As shown in FIGS. 4 to 6, 9, and 10, the cap 15 is a block. The cap 15 has a recess 151 and a peripheral wall 152. The peripheral wall 152 defines the recess 151 inside. The recess 151 extends downward from the upper surface of the cap 15.

The recess 151 includes a first space 151A and a second space 151B. The first space 151A and the second space 151B are separated by a pair of walls 153. The walls 153 protrude from the inner surface of the peripheral wall 152 in the width direction. The pair of walls 153 define a channel 154 between them, through which the protrusion 32 can pass.

The cap 15 supports the fastener 14. The cap 15 includes a positioning unit 60 for positioning the fastener 14. The positioning unit 60 includes a recess 61, to which the tab 52 on the fastener 14 is fitted. The positioning unit 60 also includes a wall 62 that at least partially surrounds the fastener 14. The wall 62 is in contact with the first and second arcs 511 and 512 of the fastener 14. The positioning unit 60 reduces changes in the relative positions of the fastener 14 and the cap 15 when the fastener 14 is supported by the cap 15.

The cap 15 includes a slide portion 63, which is guided by the guide 45 on the base 12.

The slide portion 63 includes a slide surface 631 and a slide groove 632. The slide surface 631 faces the guide surface 451 of the base 12. The guide rib 452 on the base 12 is at least partially received in the slide groove 632. The slide surface 631 includes an end surface of the peripheral wall 152. The slide groove 632 includes a notch in the peripheral wall 152. As shown in FIG. 10, the slide groove 632 on the cap 15, the channel 154 in the cap 15, and the opening 53 in the fastener 14 extend in the guide direction.

The slide portion 63 includes first slide tabs 633 and second slide tabs 634. The first slide tabs 633 are placed in the first guide groove 453 on the base 12. The second slide tabs 634 are placed in the second guide groove 454.

The first slide tabs 633 and the second slide tabs 634 protrude opposite to each other from opposite portions of a side surface of the peripheral wall 152 in the width direction. The first slide tabs 633 are two tabs spaced apart in the guide direction. The second slide tabs 634 are two tabs spaced apart in the guide direction.

As shown in FIG. 7, the base 12 has channels 46 that connect the first guide groove 453 and the end surface of the peripheral wall 122 in the axial direction. The base 12 has channels 47 that connect the second guide groove 454 and the end surface of the peripheral wall 122 in the axial direction.

The channels 46 and the channels 47, which each extend in the axial direction, are on opposite portions of the inner surface of the peripheral wall 122 in the width direction and are recessed opposite to each other in the width direction. The channels 46 are two channels arranged in the guide direction. The channels 47 are two channels arranged in the guide direction.

The first slide tabs 633 are placed in the first guide groove 453. To place the first slide tabs 633 into the first guide groove 453, the first slide tabs 633 are inserted into the channels 46 from below the peripheral wall 122. The upper ends of the channels 46 connect to the first guide groove 453. After being moved to the upper ends of the channels 46, the first slide tabs 633 are moved in the guide direction and placed into the first guide groove 453.

The second slide tabs 634 are placed in the second guide groove 454. To place the second slide tabs 634 into the second guide groove 454, the second slide tabs 634 are inserted into the channels 47 from below the peripheral wall 122. The upper ends of the channels 47 connect to the second guide groove 454. After being moved to the upper ends of the channels 47, the second slide tabs 634 are moved in the guide direction and placed into the second guide groove 454.

Figure 11:
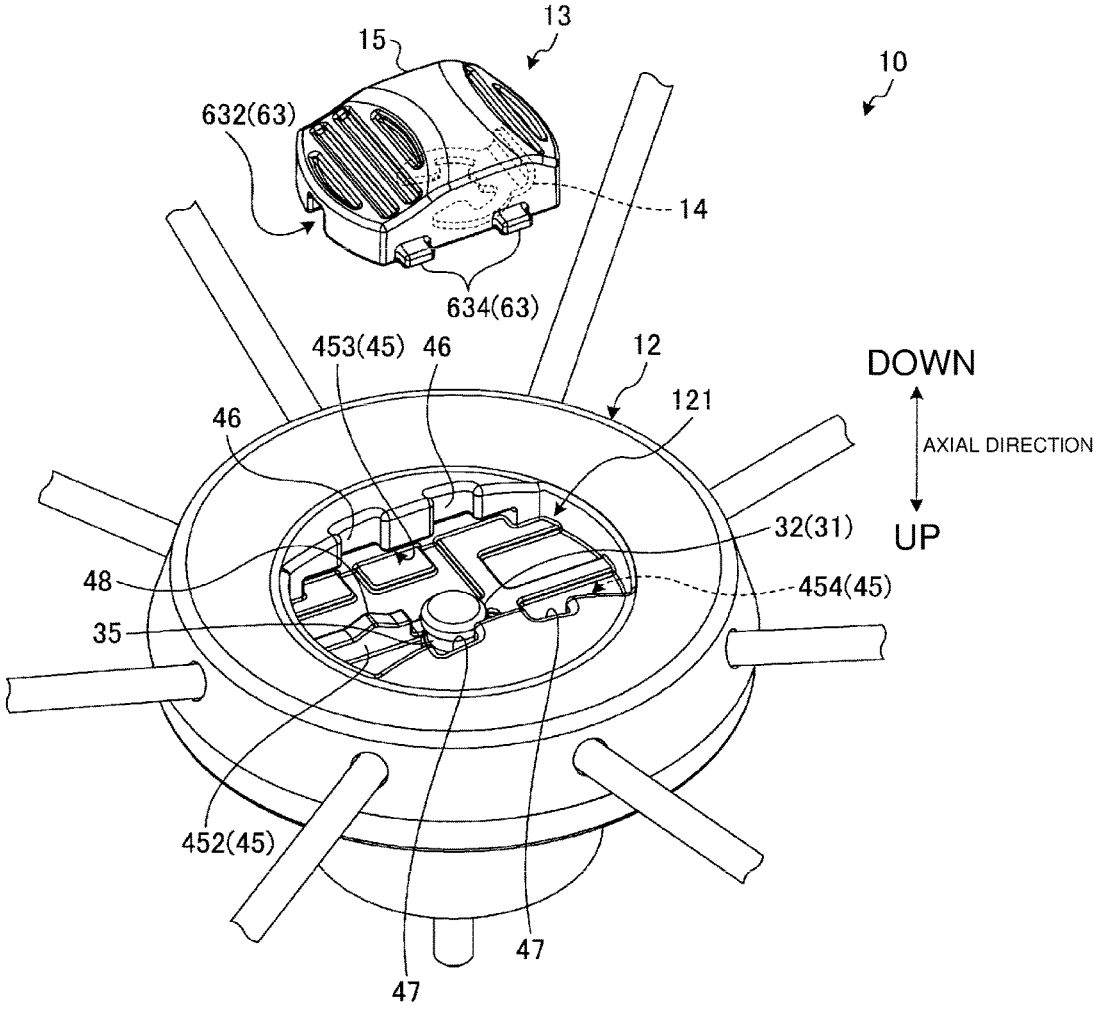
FIG. 11 is a perspective view of the base and a driving shaft that are to be locked to each other according to the embodiment.

FIG. 11 is a perspective view of the base 12 and the driving shaft 31 that are to be locked to each other in the embodiment. The driving shaft 31 is placed in the hole 42 in the base 12. The driving shaft 31 includes the protrusion 32 protruding from the lower end of the hole 42.

As described above with reference to FIG. 10, the fastener 14 is supported by the cap 15. The fastener 14 and the cap 15 are connected together to form the locking member 13.

The locking member 13 is received in the recess 121 on the base 12. The first slide tabs 633 are inserted into the channels 46, while the second slide tabs 634 are being inserted into the channels 47. After the first slide tabs 633 are moved to the upper ends of the channels 46 and the second slide tabs 634 are moved to the upper ends of the channels 47, the locking member 13 is moved in the guide direction. The first slide tabs 633 are thus received in the first guide groove 453, and the second slide tabs 634 are received in the second guide groove 454. The first slide tabs 633 are guided by the first guide groove 453. The second slide tabs 634 are guided by the second guide groove 454.

The guide rib 452 is at least partially received in the slide groove 632. The guide surface 451 and the slide surface 631 are in contact with each other.

When the first slide tabs 633 are received in the first guide groove 453 and the second slide tabs 634 are received in the second guide groove 454, the locking member 13 and the base 12 are connected together. The cap 15 covers the protrusion 32. The protrusion 32 is received in the second space 151B.

Figure 12:
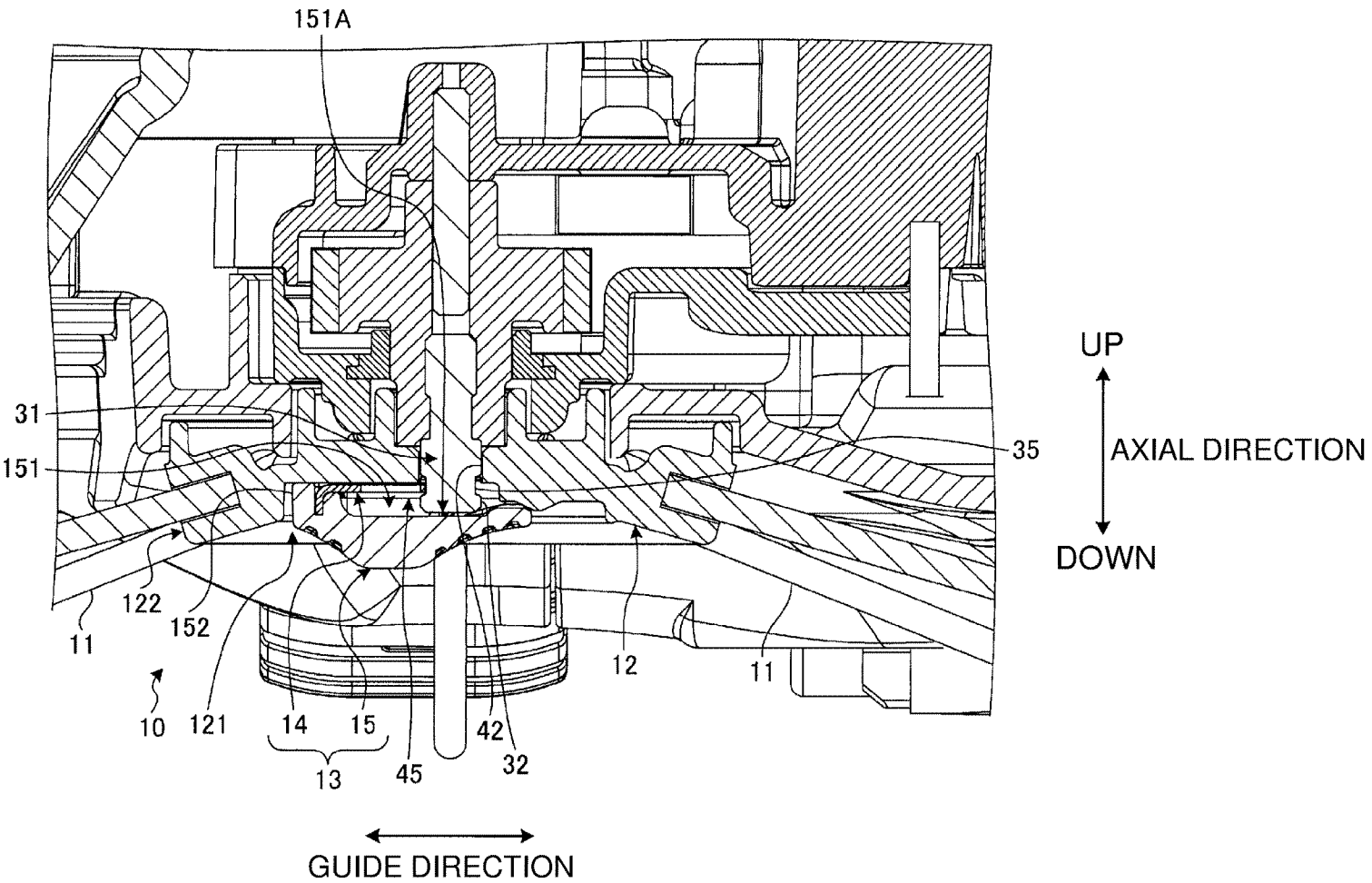
FIG. 12 is a cross-sectional view of the side brush according to the embodiment.

FIG. 12 is a cross-sectional view of the side brush 10 according to the embodiment. As shown in FIGS. 4 and 12, the locking member 13 is movable between a lock position to be in contact with the driving shaft 31 and an unlock position to be separate from the driving shaft 31, while being guided by the guide 45 on the base 12 in the guide direction.

As shown in FIG. 12, when the locking member 13 is at the unlock position to be separate from the protrusion 32 of the driving shaft 31, the protrusion 32 is received in the second space 151B of the recess 151 on the cap 15. At this position, the protrusion 32 is not in contact with the locking member 13. The protrusion 32 is located outside the space 54 of the fastener 14. When the locking member 13 is at the unlock position, the protrusion 32 is covered with the cap 15.

When the locking member 13 is at the unlock position, the first slide tabs 633 are received in the first guide groove 453 and the second slide tabs 634 are received in the second guide groove 454 although the protrusion 32 and the locking member 13 are not in contact with each other. More specifically, the first and second slide tabs 633 and 634 are engaged with the base 12. This reduces the likelihood of the locking member 13 at the unlock position being separated from the base 12. In other words, the locking member 13 at the unlock position is less likely to fall off the base 12.

In the present embodiment, the first and second guide grooves 453 and 454 function as disengagement reducing units that reduce disengagement from the locking member 13 at the unlock position.

Figure 13:
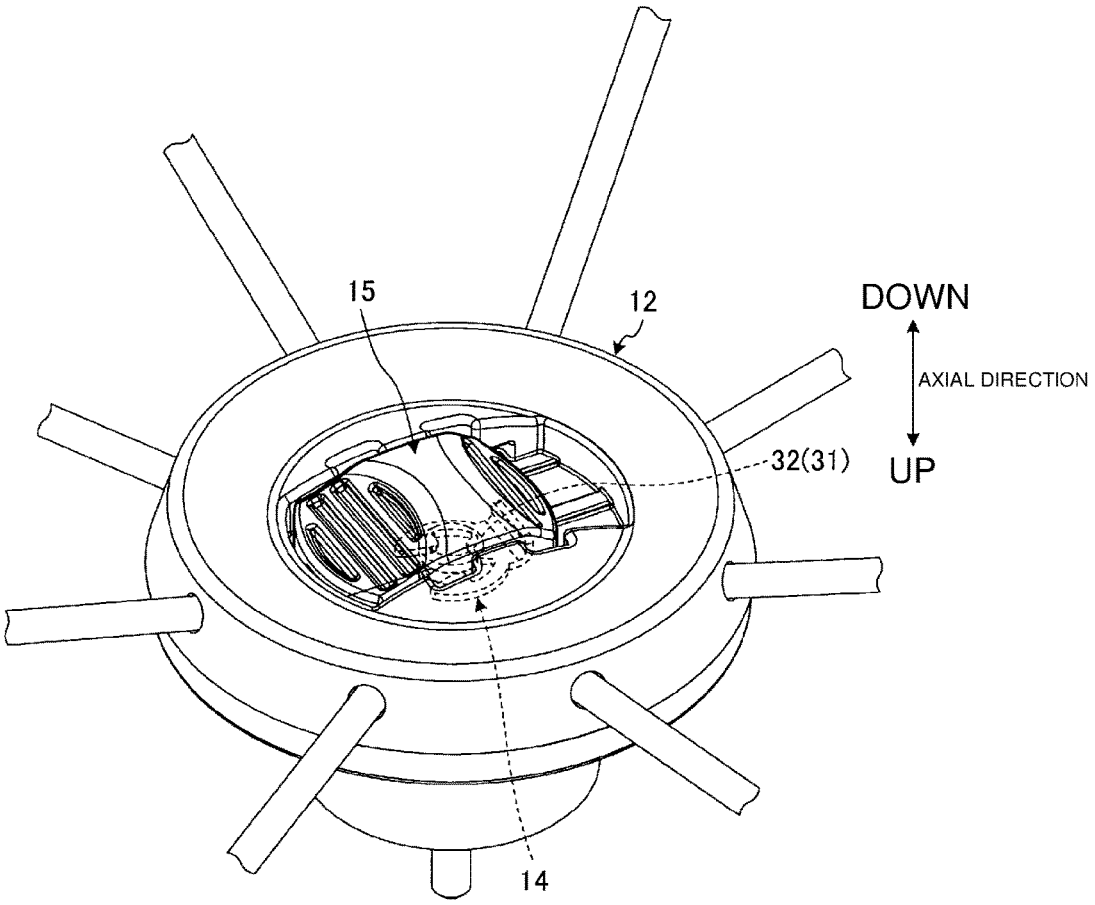
FIG. 13 is a perspective view of the side brush according to the embodiment.

FIG. 13 is a perspective view of the side brush 10 according to the embodiment. As shown in FIGS. 4 and 13, the locking member 13 at the unlock position is moved in the guide direction to the lock position at which the locking member 13 comes in contact with the protrusion 32 of the driving shaft 31. At this position, the protrusion 32 is moved from the second space 151B into the first space 151A. The protrusion 32 can pass through the channel 154. When the locking member 13 is moved from the unlock position to the lock position, the protrusion 32 passes through the channel 154 and thus moved from the second space 151B into the first space 151A.

The guide rib 452 has a projection 48 protruding downward from its lower surface. When the locking member 13 is moved from the unlock position to the lock position, the cap 15 at least partially comes in contact with the projection 48. The locking member 13 thus clicks while moving.

After moving from the second space 151B into the first space 151A, the protrusion 32 passes through the opening 53 and is received in the space 54 of the fastener 14. The fastener 14 and the protrusion 32 come in contact with each other. The fastener 14 is at least partially fitted into the groove 35 on the protrusion 32. The protrusion 32 is fastened by the fastening portion 51 of the fastener 14. The base 12 is thus locked to the driving shaft 31 by the locking member 13.

The locking member 13 is in contact with the base 12 and the driving shaft 31 to lock the base 12 to the driving shaft 31.

In the present embodiment, when the locking member 13 is at the lock position, the fastener 14 and the protrusion 32 are in contact with each other, and the cap 15 and the driving shaft 31 are not in contact with each other. When the locking member 13 is at the lock position, the cap 15 and the base 12 are in contact with each other, and the fastener 14 and the base 12 are not in contact with each other.

To unlock the base 12 from the driving shaft 31, the user moves the locking member 13 from the lock position to the unlock position. The user can detach the base 12 from the driving shaft 31. When the base 12 is detached from the driving shaft 31, the disengagement reducing unit including the first and second guide grooves 453 and 454 reduces the likelihood of the locking member 13 falling off the base 12.

Each side brush 10 according to the embodiment includes the base 12 to which the brushes 11 are attached, and the locking member 13. The locking member 13 comes in contact with the base 12 and the driving shaft 31 to lock the driving shaft 31 to the base 12. The user can easily lock each side brush 10 to the driving shaft 31 by simply moving the locking member 13 in the guide direction. The locking member 13, when in contact with the base 12 and the driving shaft 31, reduces the likelihood of the side brushes 10 coming off the driving shaft 31 during cleaning. The user can also easily detach the side brushes 10 from the driving shaft 31 by simply moving the locking member 13 in the guide direction.

The base 12 has the hole 42 for receiving the driving shaft 31. The driving shaft 31 includes the protrusion 32 protruding from the lower end of the hole 42. The locking member 13 includes the fastener 14 having the opening 53 to allow the protrusion 32 to pass through, and comes in contact with the protrusion 32 while at least partially surrounding the protrusion 32. The user can thus place the protrusion 32 into the fastener 14 through the opening 53 by simply moving the locking member 13 in the guide direction. When the fastener 14 comes in contact with the protrusion 32, the base 12 is locked to the driving shaft 31.

The fastener 14 deforms elastically to allow the protrusion 32 to smoothly pass through the opening 53. The fastener 14 is fitted to the protrusion 32 with an elastic force.

The base 12 includes the guide 45 orthogonal to the rotation axis CX. The locking member 13 includes the slide portion 63 guided by the guide 45. The guide 45 guides the locking member 13 in the direction orthogonal to the rotation axis CX. The user can easily lock the side brushes 10 to the driving shaft 31 by simply moving the locking member 13 in the guide direction. The locking member 13 includes the cap 15 supporting the fastener 14. The slide portion 63 is located on the cap 15. The user can lock the base 12 and the driving shaft 31 with the fastener 14 by simply moving the cap 15 in the guide direction.

The cap 15 includes the positioning unit 60 positioning the fastener 14. The cap 15 and the fastener 14 are thus positioned relative to each other, and are less likely to move relative to each other.

The fastener 14 includes the fastening portion 51 that at least partially surrounds the driving shaft 31 and the tab 52 protruding from the fastening portion 51 in the axial direction. The cap 15 has, as the positioning unit 60, the recess 61 into which the tab 52 is fitted. The tab 52 fitted into the recess 61 positions the cap 15 and the fastener 14 relative to each other.

The positioning unit 60 includes the wall 62 at least partially surrounding the fastener 14. The fastener 14 is in contact with the wall 62 to position the cap 15 and the fastener 14 relative to each other.

The cap 15 covers and protects the protrusion 32.

The guide 45 includes the first guide groove 453 extending in the guide direction and the second guide groove 454 facing the first guide groove 453. The slide portion 63 includes the first slide tabs 633 received in the first guide groove 453 and the second slide tabs 634 received in the second guide groove 454. The locking member 13 is thus smoothly guided in the guide direction. At the unlock position, the first and second slide tabs 633 and 634 are engaged with the respective first and second guide grooves 453 and 454, reducing the likelihood of the base 12 and the locking member 13 separating from each other.

The guide 45 has the guide surface 451 surrounding the end of the hole 42 and the guide rib 452 on the guide surface

451. The slide portion 63 has the slide surface 631 facing the guide surface 451 and the slide groove 632 at least partially receiving the guide rib 452. When the slide surface 631 in contact with the guide surface 451 slides, the locking member 13 smoothly moves in the guide direction. When the inner surface of the slide groove 632 in contact with the surface of the guide rib 452 slides, the locking member 13 smoothly moves in the guide direction.

The guide rib 452 partially surrounds the hole 42. The locking member 13 is thus smoothly movable between the lock position and the unlock position. The guide rib 452 allows the user to recognize the orientation of the base 12.

The fastener 14 is at least partially received in the groove 35 on the protrusion 32. The fastener 14 is thus less likely to come off the protrusion 32 and fitted to the protrusion 32.

The locking member 13 is movable between the lock position to be in contact with the driving shaft 31 and the unlock position to be separate from the driving shaft 31. The user can easily lock the side brush 10 to the driving shaft 31 by moving the locking member 13 to the lock position. The user can easily detach the side brush 10 from the driving shaft 31 by moving the locking member 13 to the unlock position.

The base 12 includes the disengagement reducing unit located to reduce disengagement from the locking member 13 at the unlock position. This structure thus reduces the likelihood of the locking member 13 at the unlock position falling off the base 12. The maintenance is easy for the user. This structure also reduces the likelihood of the locking member 13 being lost.

The first support surface 33 surrounds the driving shaft 31. The base 12 has the first facing surface 43 facing the first support surface 33. The first support surface 33 is orthogonal to the rotation axis CX. The first support surface 33 in contact with the first facing surface 43 axially positions the base 12 and the driving shaft 31 relative to each other.

The second support surfaces 34 surrounds the driving shaft 31. The base 12 has the second facing surfaces 44 facing the second support surfaces 34. Each second support surface 34 includes a flat surface parallel to the rotation axis CX. The second support surfaces 34 in contact with the second facing surfaces 44 radially and circumferentially position the base 12 and the driving shaft 31 relative to each other.

In the above embodiment, the locking member 13 may include the slide portion 63 and the cap 15 integral with the fastener 14. In other words, the fastener 14 and the cap 15 may be integral with each other, or may be separate units.

REFERENCE SIGNS LIST

1 robotic dust collector
1B body
2 housing
2A upper surface
2B bottom surface
2C side surface
3 bumper
4 battery mount
5 caster
6 roller
7 wheel
7D wheel motor
8 main brush
8D main brush motor
9 interface
9A operation unit
9B display
9C light emitter
10 side brush (rotary brush)
11 brush
12 base
13 locking member
14 fastener
15 cap
20 suction port
21 upper housing
22 lower housing
23 cover plate
24 bottom plate
25 suction motor
26 suction fan
30 side brush motor
30G Gear unit
31 driving shaft
32 protrusion
33 first support surface
34 second support surface
35 groove
41 recess
42 hole
43 first facing surface
44 second facing surface
45 guide
46 channel
47 channel
48 projection
51 fastening portion
52 tab
53 opening
54 space
60 positioning unit
61 recess
62 wall
63 slide portion
121 recess
122 peripheral wall
151 recess
151A first space
151B second space
152 peripheral wall
153 wall
154 channel
451 guide surface
452 guide rib
453 first guide groove
454 second guide groove
510 base
511 first arc
512 second arc
631 slide surface
632 slide groove
633 first slide tab
634 second slide tab
AX wheel rotation axis
CX rotation axis
BT battery
FL cleaning target surface

What is claimed is:

1. A rotary brush attachable to a driving shaft, the driving shaft being rotatable about a rotation axis and including a protrusion at a distal end of the driving shaft, the rotary brush comprising:

a brush;
a base to which the brush is attached; and
a locking member including
a fastener configured to contact the protrusion while surrounding the protrusion, and
a cap supporting the fastener, wherein:
the locking member is configured to contact the base and the driving shaft to lock the base to the driving shaft; and
the base, the driving shaft and the locking member are configured such that the base and the driving shaft are locked and unlocked with the fastener by moving an entirety of the cap in a guide direction perpendicular to the rotation axis.

2. The rotary brush according to claim 1, wherein
the base has a hole in a direction parallel to the rotation axis, and
the protrusion passes through the hole, and
the fastener has an opening configured to receive the protrusion.

3. The rotary brush according to claim 2, wherein
the fastener is elastically deformable.

4. The rotary brush according to claim 3, wherein
the base includes a guide surface orthogonal to the rotation axis, and
the locking member includes
a slide portion configured to be guided by the guide surface.

5. The rotary brush according to claim 2, wherein
the base includes a guide orthogonal to the rotation axis, and
the locking member includes
a slide portion configured to be guided by the guide.

6. The rotary brush according to claim 5, wherein
the cap includes a recess configured to position the fastener,
and the fastener is in the recess.

7. The rotary brush according to claim 6, wherein
the fastener includes
a fastening portion configured to at least partially surround the driving shaft; and
a tab protruding from the fastening portion in an axial direction parallel to the rotation axis, and
the recess includes an area that extends from a bottom of the recess and receives the tab.

8. The rotary brush according to claim 6, wherein
the recess includes a wall at least partially surrounding the fastener.

9. The rotary brush according to claim 5, wherein
the cap covers the protrusion.

10. The rotary brush according to claim 5, wherein
the guide includes
a first guide groove extending in the guide direction, and
a second guide groove facing the first guide groove, and
the slide portion includes
a first slide tab received in the first guide groove, and
a second slide tab received in the second guide groove.

11. The rotary brush according to claim 2, wherein
the cap is integral with the fastener.

12. The rotary brush according to claim 2, wherein
the fastener is at least partially receivable in a groove on the protrusion.

13. The rotary brush according to claim 1, wherein
the locking member is movable between a lock position contacting the driving shaft and an unlock position spaced from the driving shaft.

14. The rotary brush according to claim 13, wherein
the base is configured to provide limited disengagement between the base and the locking member at the unlock position.

15. The rotary brush according to claim 13,
wherein the locking member and the base are configured such that the locking member is retained by the base when the locking member is in the unlock position.

16. The rotary brush according to claim 1, wherein
the base has a first facing surface facing a first support surface surrounding the driving shaft and orthogonal to the rotation axis.

17. The rotary brush according to claim 16, wherein
the base has a second facing surface facing a second support surface surrounding the driving shaft and including a flat surface parallel to the rotation axis.
the positioning unit includes a wall at least partially surrounding the fastener.

18. A robotic dust collector, comprising:
a housing including a bottom surface having a suction port;
a brush motor in the housing;
a driving shaft driven by the brush motor to rotate about a rotation axis; and
the rotary brush according to claim 1 attached to the driving shaft.

19. A rotary brush attachable to a driving shaft, the driving shaft being rotatable about a rotation axis and including a protrusion, the rotary brush comprising:
a brush;
a base to which the brush is attached; and
a locking member (i) including a slide portion, a fastener and a cap
and (ii) configured to come in contact with the base and the driving shaft to lock the base to the driving shaft, wherein
the base has a hole having an end from which the protrusion protrudes, and
the fastener has an opening to allow the protrusion to pass through and configured to come in contact with the protrusion while at least partially surrounding the protrusion,
the base includes a guide orthogonal to the rotation axis,
the slide portion is configured to be guided by the guide,
the cap is configured to support the fastener,
the guide has
a guide surface surrounding the end of the hole, and
a guide rib on the guide surface, and
the slide portion has
a slide surface facing the guide surface, and
a slide groove at least partially receiving the guide rib.

20. The rotary brush according to claim 19, wherein
the guide rib partially surrounds the hole.

* * * * *